United States Patent [19]

Richardson

[11] Patent Number: 5,025,770

[45] Date of Patent: Jun. 25, 1991

[54] APPARATUS AND ENGINE TO PROVIDE POWER TO THE APPARATUS

[75] Inventor: David A. Richardson, Alton, United Kingdom

[73] Assignee: J. C. Bamford Excavators Limited, United Kingdom

[21] Appl. No.: 377,436

[22] Filed: Jul. 7, 1989

[30] Foreign Application Priority Data

Nov. 12, 1987 [GB] United Kingdom ..... 8726520
Nov. 8, 1988 [GB] United Kingdom PCT/GB88/00959

[51] Int. Cl.[5] ..... F02B 23/00

[52] U.S. Cl. ..... 123/585; 123/198 DB; 123/357

[58] Field of Search ..... 123/386, 385, 387, 198 DB, 123/357-359; 414/699

[56] References Cited

U.S. PATENT DOCUMENTS

| | | | |
|---|---|---|---|
| 4,373,850 | 2/1983 | Durham | 123/386 |
| 4,422,420 | 12/1983 | Cromas | 123/458 |
| 4,454,783 | 6/1984 | Sierk | 123/198 DB |
| 4,515,125 | 5/1985 | Bock | 123/198 DB |
| 4,638,779 | 1/1987 | Kitada | 123/385 |
| 4,643,146 | 2/1987 | Spriessler | 123/385 |
| 4,773,369 | 9/1988 | Kobayashi | 123/385 |
| 4,836,165 | 6/1989 | Kubota | 123/385 |
| 4,838,755 | 6/1989 | Johnson | 123/385 |
| 4,877,005 | 10/1989 | Law | 123/458 |
| 4,917,063 | 4/1990 | Hiraki | 123/458 |

*Primary Examiner*—Carl Stuart Miller
*Attorney, Agent, or Firm*—Christie, Parker & Hale

[57] ABSTRACT

A combination of an apparatus (22) and an engine (30) to provide power to the apparatus, a vehicle (10) of the type having a hydraulic system for operating digging, excavating, or shovelling tools (16,21) for examples, the hydraulic system being pressurized by a pump (33) which is driven from the engine (30) of the vehicle, there being a fuel delivery system for providing fuel to the engine, and a sensing means (49) to sense operation of the apparatus, the fuel delivery system comprising means (48) responsive to the sensing means (49) to provide a first quantity of fuel to the engine (50) when the apparatus (22) is being operated, and to provide a second, reduced, quantity of fuel to the engine (30) when the apparatus has not been operative for a predetermined delay time.

17 Claims, 3 Drawing Sheets

APPARATUS AND ENGINE TO PROVIDE POWER TO THE APPARATUS

CROSS-REFERENCE TO RELATED APPLICATIONS

Figure 1:
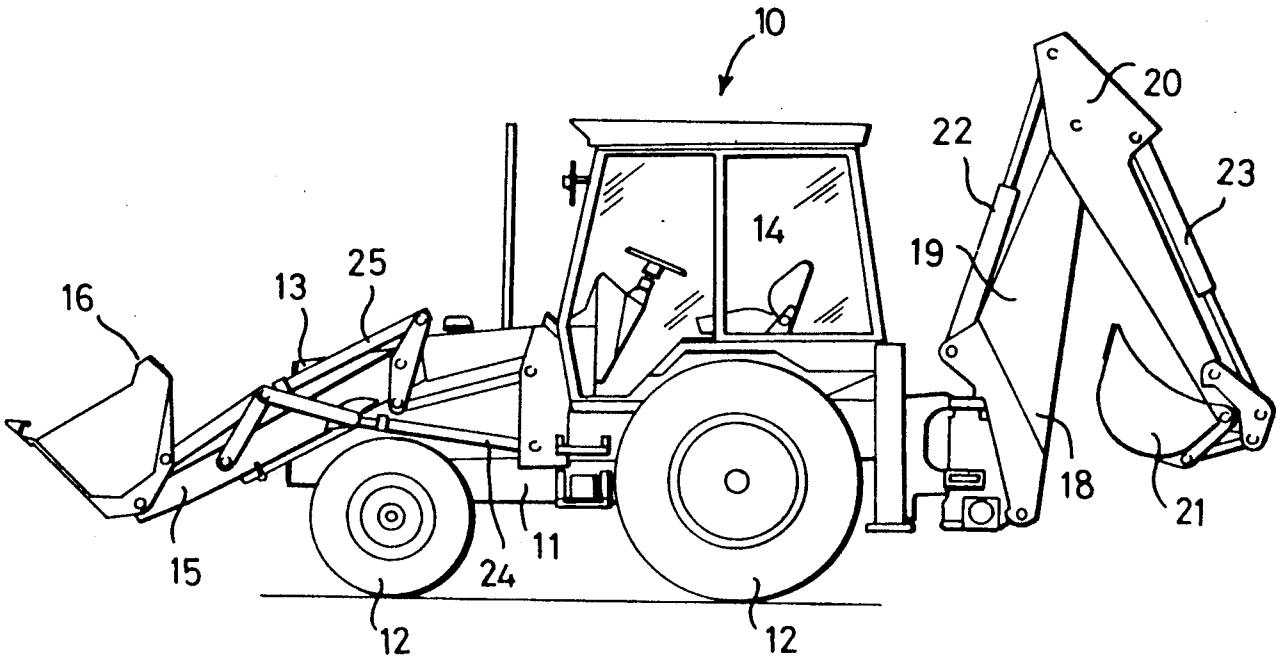

This is a Continuation to the patent application entitled APPARATUS AND ENGINE TO PROVIDE POWER TO THE APPARATUS, Application Serial No. PCT/GB88/00959, filed Nov. 8, 1988, which claims priority upon United Kingdom Patent application entitled APPARATUS AND ENGINE TO PROVIDE POWER TO THE APPARATUS, Application Serial No. 8,726,520, filed Nov. 12, 1987, and Applicant claims priority based thereon.

DESCRIPTION OF INVENTION

This invention relates to an apparatus and an engine to provide power to the apparatus.

More particularly, but not exclusively, the invention has been developed for an apparatus comprising a vehicle of the type having a hydraulic system for operating digging, excavating, or shovelling tools for examples, the hydraulic system being pressurised by a pump which is driven from an engine of the vehicle.

It will be appreciated by those skilled in the art, that operation of the hydraulic pump imposes a significant power demand on the engine and so it is necessary when operating the hydraulic system, at least when the vehicle is stationary, for the operator to adjust the engine speed to be greater than a normal idling speed.

Hence the engine may be operated above idle speed for a considerable time even though the hydraulic system may be not be in use for other than a small part of this time. Accordingly there is a considerable wastage of fuel in maintaining the engine speed unecessarily high when the hydraulic system is not in use and also operating the engine at higher than a necessary speed causes premature wear of the engine as well as causing unnecessary noise and pollution.

According to one aspect of the invention we provide in combination, an apparatus, an engine to power the apparatus, a fuel delivery system for providing fuel to the engine, and a sensing means to sense operation of the apparatus, the fuel delivery system comprising control means responsive to the sensing means to provide a first quantity of fuel to the engine when the apparatus is being operated, and to provide a second quantity of fuel to the engine which is reduced compared with the first quantity when the apparatus has not been operative for a predetermined time, the control means automatically returning the fuel supply to the first quantity when the sensing means senses that the apparatus is again operative, one of the first and second quantities of fuel being that permitted by the setting of a throttle, the control means changing the quantity of fuel in response to the sensing means, without altering the throttle setting.

In one example, the fuel delivery system comprises a restrictor which is operable by the control means to restrict the fuel supply to the engine to the second quantity which is less than the first quantity permitted by the setting of the throttle, when the apparatus has not been operative for the predetermined delay time.

The predetermined delay time which may be a minimum of zero seconds or a maximum time of as long as required e.g. five seconds or more.

In this way, the engine speed and hence available power to the apparatus being powered does not change during normal use of the apparatus which may involve short periods in which the apparatus is not in use, but only during for example rest periods of longer than the predetermined delay time.

According to a second aspect of the invention we provide a vehicle including an apparatus, and an engine and a fuel delivery system, in accordance with the first aspect of the invention.

The engine of the vehicle may be operative in addition to powering the apparatus, to drive the vehicle over the ground. The control means may be arranged only to affect the engine speed when a transmission between the engine and a ground engaging means, e.g. wheels or tracks of a vehicle, is disengaged e.g. where the vehicle has a gearbox, when the vehicle is in neutral gear.

Figure 2:
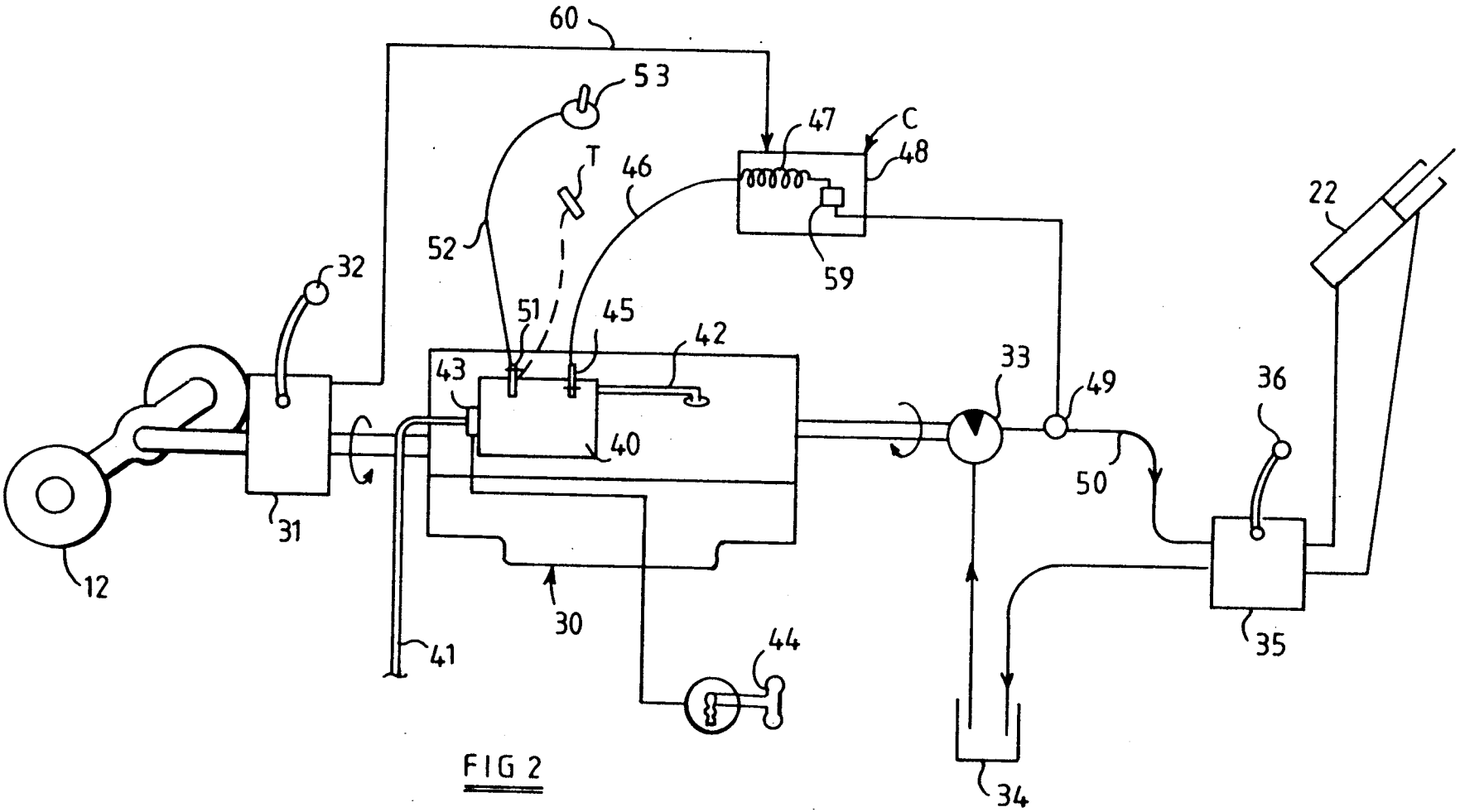
Figure 3:
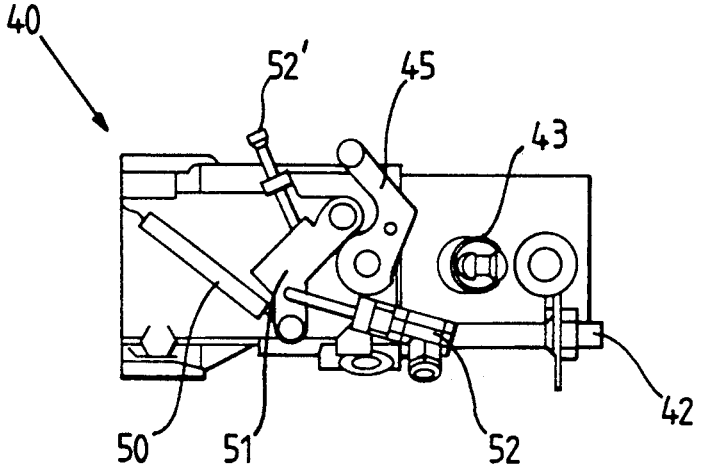

The invention will now be described with the aid of the accompanying drawings in which:

FIG. 1 is a diagrammatic side view of a vehicle which may embody the invention, FIG. 2 is an illustrative view of part of the vehicle of FIG. 1 illustrating the invention, FIG. 3 is a diagrammatic view of a fuel injection pump which may be adapted for use according to the invention.

Referring to the drawings, an excavating/loading vehicle 10 comprises a body 11 having two pairs of ground-engaging wheels 12 which are driven from an engine mounted beneath a bonnet 13 of the vehicle.

The body 11 includes an operator's cab 14 from which the operator may control the vehicle 10.

At a front end of the vehicle 10, a loading arm 15 is provided which has at an outer end thereof, a loading bucket 16.

At the rear end of the vehicle, an excavating arm 18 is provided which comprises a boom 19, on which is pivotally mounted a dipper 20 which carries at one end, an excavating bucket 21.

The dipper 20 is movable relative to the boom 19 by means of a hydraulic actuator 22, and the excavating bucket 21 may be moved relative to the dipper 20 by means of a further hydraulic actuator 23.

The loader arm 15 may be moved relative to the body of the vehicle by means of a pair of hydraulic actuators 24 mounted at either side of the bonnet 13, and the bucket 16 may be pivoted relative to the arm 15 by means of a further pair of hydraulic actuators as shown at 25.

Referring now to FIG. 2, the engine is shown diagrammatically at 30.

The engine drives the ground-engaging wheels 12 via a transmission which includes a gear box 31 having a control lever 32 within the operator's cab 14.

The engine 30 further provides power to a hydraulic pump 33 of an apparatus comprising a hydraulic system of the vehicle of FIG. 1, which pump 33 pumps fluid from a hydraulic reservoir 34 to a control valve 35 which provides hydraulic fluid under pressure to the various hydraulic actuators 22,23,24,25, of the system, although only one i.e. hydraulic actuator 22 is shown in FIG. 2 for clarity, when an appropriate control lever (only one lever 36 for actuator 22 of the system being shown) within the operator's cab 14, is operated.

The engine 30 is of the diesel type, fuel being fed to an injector fuel pump 40 via a fuel feed line 41 from a tank (not shown), the pump 40 being adapted to feed fuel to injectors of the engine, along a plurality of feed lines 42, one being provided for each cylinder of the engine 30.

The feed line 41 has a solenoid operated valve 43 which in practice may be an integral part of the pump 40 which is operated by an ignition key 44, again within the operator's cab 14. When the valve 43 is closed by turning the ignition key 44 to an off position, the fuel supply to the engine 30 is cut off so that the engine stops.

The fuel injector pump 40 also provides a mechanical device for restricting the fuel supply fed to feed lines 42, the mechanical device including a control which is a lever 45 which is operated via a cable 46 from a solenoid device 47 of a control means C.

The control means C has a control circuit 48 which is connected electrically to a sensing means 49 which senses the hydraulic pressure within a hydraulic line 50 from the pump 33 to the control valve 35, and sensing means 49 is arranged to provide a signal to control circuit 48 whenever the sensing means 49 senses an increase in pressure in the line 50 above a first threshold value which is achieved in line 50 when one or more of the actuators 22 to 25 are operated, so that the mechanical restrictor device control lever 45 is moved to a fully open position so as to permit the free flow of fuel along lines 42 to the engine 30 permitted by the setting of a throttle lever 51 as hereinafter described.

When the sensing means 49 senses a decrease in pressure below a second, preferably different, threshold value, determined according to the precise characteristic of valve 35, which indicates that the actuators 22 to 25 are no longer in use, a further signal is sent to the control circuit 48, to cause the solenoid 47 to move the mechanical restrictor control lever 45 to an intermediate position so that the flow of fuel to lines 42 is restricted. However, the control circuit 48 incorporates a delay means 59 so that the solenoid 47 only operates to move the control lever 45 to restrict the fuel flow to lines 42, after a predetermined time delay from when the sensor means 49 senses that the pressure in line 50 is below the second threshold value.

Instead of providing a sensing means 49 in the position shown, a flow rate sensing means 49 may be provided in each of the feed lines between valve 35 and the respective actuators 22 to 25, and each such sensing means 49 may be connected in parallel, so that an increase in fluid in any of the feed lines, as any of the actuators 22–25 is operated results in a signal to the circuit 48 to open control lever 45 fully. Further alternatively, appropriate pressure sensors could be provided in each of the feed lines between valve 35 and the respective actuators 22 to 25.

In each of these cases, all of the actuators 22–25 would need to be at rest before the solenoid moves the control lever 45 to the intermediate position.

In FIG. 3, a typical fuel injector pump 40 is shown which has a spring 50 which normally biases a throttle lever 51 to an idling position, the throttle lever 51 being connected via a connector and cable 52 to a preferably hand operated throttle control 53 within the operator's cab 14 so that the operator may set the throttle at any desired position. Of course, a further throttle control may be provided (as shown in dotted lines in FIG. 2 at T) to enable the operator to accelerate the vehicle when driving the vehicle 10, which further throttle control would preferably be foot operated.

The idle position for the throttle lever 51 is controlled by means of a stop 52' which is adjustable so that the idle position of the fuel pump 40 can be adjusted.

The mechanical restrictor control lever 45 is shown which again is movable by the cable 46 as described above.

The control lever 45 of the mechanical restrictor device is conventionally provided on a fuel injector pump 40, although conventionally, the control lever 45 is movable only from an open position beyond an intermediate position to be described, to a stop position when the device operates to completely stem the flow of fuel to the feed line 42 and hence to the engine 30, so that the engine 30 may be stopped. Thus a conventional fuel pump 40 may be provided although operation of the fuel pump 40 in accordance with the invention requires the sensing means 49, control circuit 48, and cable 46.

Operation of the hydraulic actuator 22 and engine 30 will now be described.

When the transmission 31 is in neutral, the operator may set the hand throttle control 53 to obtain a required engine speed, to enable sufficient power to be provided to the hydraulic pump 33 to operate the hydraulic actuator 22 and other hydraulic actuators 23–25 of the vehicle 10. Upon operation of any of the hydraulic actuators, using for example control lever 36, an increase in pressure above the first threshold value will be sensed in the feed line 50 by the sensing means 49, and accordingly, the control circuit 48 will respond so as to maintain the control lever 45 in a fully open position to permit the free flow of fuel as permitted by the throttle setting to the feed lines 42 for injection into the engine 30.

However, if at any time none of the hydraulic actuators 22–25 are operated, the pressure in feed line 50 will fall, as fluid will simply pass through the control valve 35 and be returned to the reservoir 34.

When a second threshold pressure, lower than the first threshold pressure is sensed, a signal will be provided to the control means 48, and after a predetermined time which is preferably adjustable from zero seconds upwards, for example five seconds, determined by the delay means 59, the solenoid 47 will be operated to move the control lever 45 to the intermediate position described, so that the flow of fuel along lines 42 is restricted, and thus the engine speed will fall. If during the predetermined delay, the control lever 36 or any other actuator 22–25 is again operated, the circuit 48 will maintain the control lever 45 in the fully open position. Thus the engine speed is only reduced when the hydraulic apparatus is not used for a predetermined time, for example during a rest period when the excavating bucket 21 or loading bucket 16 or auxiliary hydraulic device which involves the use of the hydraulic pump 33, is not in use.

Thus in this embodiment, the mechanical device will override the throttle control 53 to reduce the fluid flow to the engine 30 irrespective of the throttle setting when the apparatus is not in use.

If at any time it is desired to stop the engine 30, this may be achieved by operating the ignition key 44 to deactivate the solenoid 43.

If the vehicle is driven, immediately a gear is selected in the gear box 31 of the transmission, a signal is sent from the gear box 31 to the control circuit 48 along line 60 to override operation of the solenoid 47 so that the control lever 45 is maintained in a fully open position. Further, whilst the vehicle is in gear, the solenoid 43 is rendered inoperative so that the restrictor is not operational.

Although the solenoid 47 may be operated so as to move the control lever 45 to the intermediate position instantly after the predetermined delay time, the actual speed of operation of the solenoid may be controllable so that the fuel supply is only restricted progressively, although preferably, the response to operation of the hydraulic system restores the fuel supply more quickly.

Various modifications may be made without departing from the scope of the invention. For example, the vehicle shown in FIG. 1 is only an example of a vehicle which may incorporate the invention. The invention may be applied to a loading vehicle which need not have an excavating arm 18 at the rear, or may be applied to a vehicle having tracks instead of ground-engaging wheels 12. The vehicle may have other hydraulic operated apparatus such as an hydraulically operated hammer alternative to or additional to the loading shovel 16 or excavating bucket 21 described.

If desired, instead of providing solenoid 43 operated by an ignition key 44, the control lever 45 may be movable into the intermediate position by the control means C as described, and may be movable to a further stop position in which fluid flow to lines 42 is cut off altogether, under the control of the operator.

Instead of being controlled by the solenoid 47 acting through the cable 46, the control lever 45 of the mechanical restrictor device may be operated by an alternative e.g. electrically operated means, but preferably incorporating a delay means 59 so as to provide a predetermined delay between the time in which the sensing means 49 senses a low pressure for example in line 50 and when the lever 45 is moved to the intermediate position.

If desired, instead of a sensing means 49 sensing the pressure in line 50, a sensor to sense a pressure in the valve 35 may be provided. Alternatively, a sensing means to sense movement of each of the control levers like lever 36, or even of a working part such as the dipper arm 20 moved by the actuator 22 could be provided. Further alternatively, the sensing means could comprise strain gauges or the like, in lever 36 and the other levers but in each case, the sensing means 49 is sensitive to operation of any of the hydraulic apparatus.

In another embodiment, instead of reducing the fuel supply when the apparatus is not in use, to provide less fuel than permitted by the throttle setting, an arrangement may include means to boost the fuel supply above that permitted by the throttle setting, when operation of any hydraulic or other apparatus powered by the engine, is sensed.

This could be achieved in the arrangement described by causing the control lever 45 normally to assume the intermediate position, and for the control means to respond to the sensing means 49 when sensing operation of the apparatus, by moving the lever 45 to a fully open positon. When the sensing means 49 again senses that the apparatus is no longer in use, the control means 48 may respond, by moving the control lever 45 of the mechanical device back to the intermediate position, after the predetermined time delay, so that the quantity of fuel delivered to the engine 30 is again entirely dependent upon the throttle setting.

In another arrangement, the invention may be applied to an apparatus not comprising a vehicle, but having an engine to power an apparatus which need not be hydraulic.

Although the invention has been described as applied to a diesel engine 30, the invention may be applied to a petrol engine, particularly, but not exclusively, a petrol engine in which fuel is fed into the engine by means of injectors rather than via a simple carburettor.

In each case however, the engine speed is less when the apparatus powered by the engine has not been operative for a predetermined delay time than when the apparatus is in use so as to minimise the quantity of fuel used by the engine, but the actual set throttle position is not changed.

What is claimed is:

1. In combination, an apparatus, an engine to power the apparatus, a fuel delivery system for providing fuel to the engine, and a sensing means to sense operation of the apparatus, the fuel delivery system comprising an engine speed control by which an operator can set the engine speed control means responsive to the sensing means to allow a first quantity of fuel to be fed to the engine when the apparatus is being operated, the first quantity of fuel being that permitted by the setting of the engine speed control, and to operate a restrictor device which is separate from the settable engine speed control, to restrict the fuel supply to provide a second quantity of fuel to the engine which is reduced compared with the first quantity when the apparatus has not been operative for a predetermined time, the control means automatically returning the fuel supply to the first quantity when the sensing means senses that the apparatus is again operative, the control means changing the quantity of fuel in response to the sensing means, without altering the setting of the engine speed control.

2. A combination according to claim 1 wherein the control means comprises a solenoid to operate the restrictor device, the solenoid receiving an electrical signal from the control means via a control circuit which includes a delay means.

3. A combination according to claim 1 wherein the apparatus comprises a hydraulic system.

4. A combination according to claim 3 wherein the sensing means is sensitive to the pressure in the hydraulic system.

5. In combination, an apparatus, an engine to power the apparatus, a sensing means to sense operation of the apparatus, a fuel injection pump for injecting fuel into the engine, the fuel delivery system comprising a fuel injection pump for injecting fuel into the engine, the pump having an engine speed control operable under the control of an operator to set the engine speed and a restrictor device operable at least partially to restrict the fuel supply to the engine, control means responsive to the sensing means to operate the restrictor device to provide a first quantity of fuel to the engine when the apparatus is being operated, and to provide a second quantity of fuel to the engine which is reduced compared with the first quantity when the apparatus has not been operative for a predetermined time, the control means automatically operating the restrictor device to return the fuel supply to the first quantity when the sensing means senses that the apparatus is again operative, one of the first and second quantities of fuel being that permitted by the setting of the engine speed control, the control means changing the quantity of fuel in response to the sensing means without altering the setting of the engine speed control.

6. A combination according to claim 5 wherein the control means comprises a solenoid to operate the restrictor device, the solenoid receiving an electrical signal from the control means via a control circuit which includes a delay means.

7. A combination according to claim 5 wherein the engine is a diesel engine, the restrictor device of the fuel injection pump comprising a mechanical fuel cut-off device which is capable, when a control thereof is moved to a stop position, of stopping the engine by completely cutting off the fuel supply, the control means on receiving a signal from the sensing means indicating that the apparatus has not been operative for a predetermined delay time, moving the control of the mechanical fuel cut-off device to an intermediate position in which the fuel supply to the engine is partially restricted wherein the second quantity of fuel is provided to the engine, the control means responding when the sensing means senses that the apparatus is again in use, by moving the control of the mechanical cut-off device to a fully open position to allow the fuel delivery system to provide the first quantity of fuel to the engine.

8. A combination according to claim 7 wherein the fuel injection pump has in addition to the mechanical fuel cut-off device, a solenoid operated valve which is operable to stop the engine by completely cutting off the fuel supply.

9. A combination according to claim 5 wherein the apparatus comprises a hydraulic system.

10. A combination according to claim 9 wherein the sensing means is sensitive to hydraulic pressure in the hydraulic system.

11. A vehicle comprising an apparatus, a diesel engine to power the apparatus and to drive the vehicle over the ground, a fuel delivery system for providing fuel to the engine, and a sensing means to sense operation of the apparatus, the fuel delivery system comprising control means responsive to the sensing means to provide a first quantity of fuel to the engine when the apparatus is being operated, and to provide a second quantity of fuel to the engine which is reduced compared with the first quantity when a transmission between the engine and a ground engaging propulsion means is disengaged and the apparatus has not been operative for a predetermined time, the control means automatically returning the fuel supply to the first quantity both when the sensing means senses that the apparatus is again operative, and when the transmission is engaged, one of the first and second quantities of fuel being that permitted by the setting of an engine speed control, the control means changing the quantity of fuel in response to the sensing means, without altering the setting of the engine speed control.

12. A vehicle according to claim 11 wherein the fuel delivery system comprises a fuel injection pump for injecting fuel into the engine, the pump having an engine speed control operable under the control of an operator to set the engine speed, and a restrictor device which is operable by the control means at least partially to restrict the fuel supply to the engine to the second quantity when the transmission is engaged and when the apparatus has not been operative for the predetermined time.

13. A vehicle according to claim 12 wherein the control means comprises a solenoid to operate the restrictor device, the solenoid receiving an electrical signal from the control means via a control circuit which includes a delay means.

14. A vehicle according to claim 12 wherein the restrictor device of the fuel comprises a mechanical fuel cut-off device which is capable when a control thereof is moved to a stop position, of stopping the engine by completely cutting off the fuel supply, the control means on receiving a signal from the sensing means indicating that the apparatus has not been operative for a predetermined delay time when the transmission is in neutral, moving the control of the mechanical cut-off device to an intermediate position in which the fuel supply to the engine is partially restricted wherein the second quantity of fuel is provided to the engine, the control means, when the sensing means senses that the apparatus is again in use, or that the transmission has been engaged, respond by moving the control of the mechanical fuel cut-off device to a fully open position to allow the fuel delivery system to provide the first quantity of fuel to the engine.

15. A vehicle according to claim 14 wherein the fuel injection pump has in addition to the mechanical fuel cut-off device, a solenoid operated valve which is operable to stop the engine by completely cutting off the fuel supply.

16. A vehicle according to claim 11 wherein the apparatus comprises a hydraulic system.

17. A vehicle according to claim 16 wherein the sensing means is sensitive to the hydraulic pressure in the hydraulic system.

* * * * *

UNITED STATES PATENT AND TRADEMARK OFFICE

CERTIFICATE OF CORRECTION

PATENT NO. : 5,025,770

DATED : June 25, 1991

INVENTOR(S) : David A. Richardson

It is certified that error appears in the above-identified patent and that said Letters Patent is hereby corrected as shown below:

Column 1, line 33, after "may" delete "be".
Column 1, line 35, change "unecessarily" to
-- unnecessarily --.
Column 1, line 65, change "e.g." to -- , e.g., --.
Column 2, line 2, change "during for example" to
-- during, for example, --.
Column 2, line 8, after "operative" insert a comma.
Column 2, line 12, insert a comma after "e.g.".
Column 2, line 13, change "e.g." to -- , e.g., --.
Column 2, line 37, after "end" delete the comma.
Column 2, line 60, change "i.e." to -- , i.e., --.
Column 4, line 24, change "using for example" to
-- using, for example, --.
Column 5, line 28, change "e.g." to --, e.g., --.
Column 6, line 3, change "carburettor" to
-- carburetor --.

Signed and Sealed this

Thirteenth Day of April, 1993

*Attest:*

STEPHEN G. KUNIN

*Attesting Officer*

*Acting Commissioner of Patents and Trademarks*